United States Patent [19]

Endo et al.

[11] 4,336,782

[45] Jun. 29, 1982

[54] FUEL FEED DEVICE FOR ENGINE

[75] Inventors: Norio Endo, Kameoka; Tatsuro Nakagami, Kyoto, both of Japan

[73] Assignees: Mitsubishi Jidosha Kogyo Kabushiki Kaisha; Mitsubishi Denki Kabushiki Kaisha, both of Tokyo, Japan

[21] Appl. No.: 142,048

[22] Filed: Apr. 21, 1980

[30] Foreign Application Priority Data

Apr. 23, 1979 [JP] Japan ..... 54/50084

[51] Int. Cl.[3] ..... F02M 51/02

[52] U.S. Cl. ..... 123/494; 123/478

[58] Field of Search ..... 123/478, 479, 494

[56] References Cited

U.S. PATENT DOCUMENTS 3,818,877 6/1974 Barrera et al. ..... 123/494

4,155,332 5/1979 Yaegashi et al. ..... 123/494 X

*Primary Examiner*—Tony M. Argenbright

*Attorney, Agent, or Firm*—Robert E. Burns; Emmanuel J. Lobato; Bruce L. Adams

[57] ABSTRACT

A fuel feed device for an engine comprises an electric control to control opening and closing of a fuel injection valve in accordance with electric signals output from an operating condition detector prior to the electric signals from an air flow rate detecting device, when the engine is operated under a specific driving condition such as a low speed and high load driving condition. Another electric control can control opening and closing of the fuel injection valve in accordance with the electric signal output from the air flow rate detecting device when the engine is under other driving conditions, so that the present invention has the advantage that highly reliable electronically controlled fuel feed is effected.

7 Claims, 3 Drawing Figures

FUEL FEED DEVICE FOR ENGINE

BACKGROUND OF THE INVENTION

This invention relates to a fuel feed device for an engine provided with an electromagnetically controlled fuel injection valve capable of injecting fuel into an intake passage, and more particularly to a fuel feed device for an engine capable of electronically controlling the fuel feed rate.

Conventionally, a fuel feed device for an engine electronically controls the fuel feed rate by operating an electromagnetic-controlled fuel injection valve with pulse signals based on electric signals generated by the electrical conversion of the intake air flow rate. However, it has been found that the conventional device is unsatisfactory in fine controlling and fails to provide reliability, and further improvements of it are required.

Accordingly, an object of the present invention is to solve the above-mentioned problems and to provide a fuel feed device for an engine capable of electronically controlling the fuel feed rate in response to the operation of the engine to achieve fine control and improvement of reliability.

SUMMARY OF THE INVENTION

In order to attain the object, a fuel feed device for an engine according to the invention, comprises an air flow rate detecting device to generate an electric signal having a frequency proportional to an air flow rate suctioned through an intake passage, an electromagnetically actuated fuel injection valve which is disposed down-stream of said air flow rate detecting device to control the fuel feed rate into said intake passage, a fuel pressure regulator to maintain the pressure difference between a feeding fuel pressure to said fuel injection valve and a suction pressure near a fuel outlet of said fuel injection valve constant, first electric control means to control opening and closing of said fuel injection valve so that it will synchronize with at least either a frequency of the electric signal generated by said air flow rate detecting device or a divided-down frequency thereof, a specific operating condition detecting means for detecting a specific operating condition of said engine, second electric control means to control opening and closing of said fuel injection valve by means of electric signals transmitted from said specific operating condition detecting means, and under the specific operating condition of said engine, said fuel injection valve is actuated by said second electric control means, while under the other operating conditions, said fuel injecting valve is controlled by said first electric control means.

BRIEF DESCRIPTION OF THE DRAWINGS

Referring to the drawings, explanation will be made of a fuel feed device for an engine embodied according to the present invention, wherein.

DESCRIPTION OF THE PREFERRED EMBODIMENT

Figure 1:
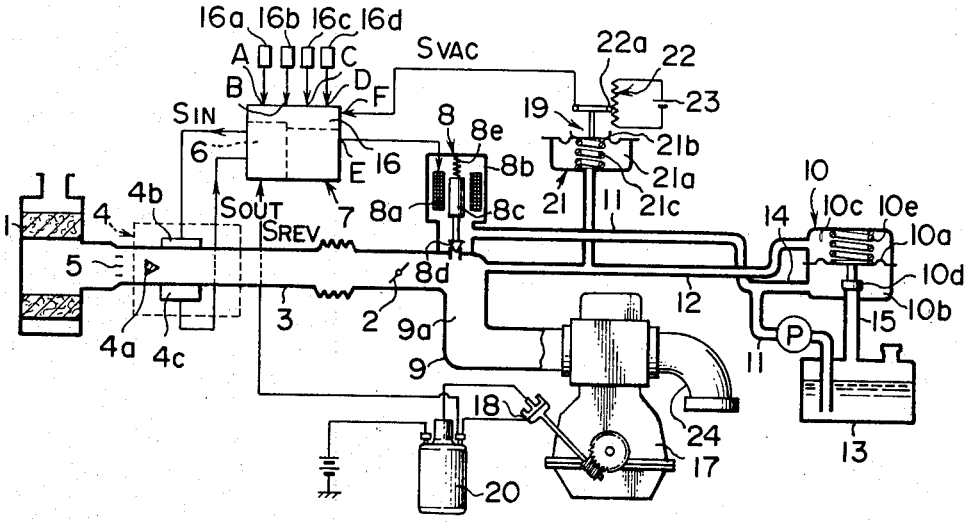
FIG. 1 is a schematic illustration of a fuel feed device.
Figure 2:
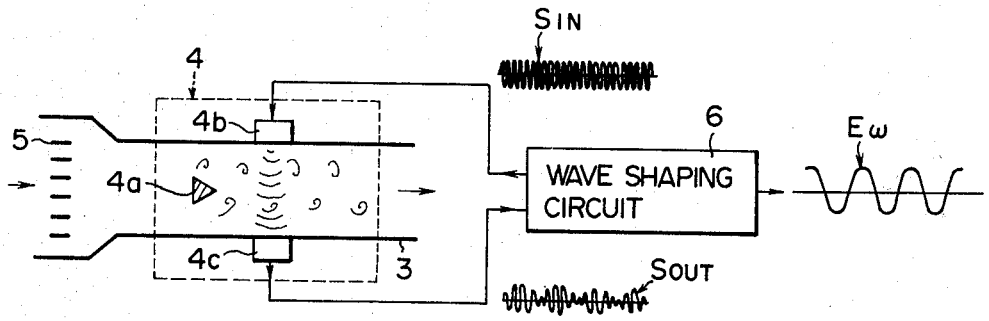
FIG. 2 is a schematic illustration to explain the function of the air flow detecting device of the present invention.

Referring to FIGS. 1 and 2, an air flow rate detecting device 4 is disposed on an intake passage 3 between an air cleaner 1 and a throttle valve 2.

The air flow rate detecting device 4 consists of a triangular prism 4*a* disposed perpendicularly against the suction air flowing direction, a speaker 4*b* functioning as an ultrasonic wave generator and a microphone 4*c* functioning as an ultrasonic wave receiver both disposed at the down stream side of the triangular prism 4*a* on the outer wall of the intake passage 3 opposite each other. Reference numeral 5 designates a suction air flow rectifier provided for rectifying the suction air flow thus assuring stabilized operation of the intake air rate detecting device 4.

As the suction air rectified by the rectifier 5 streams within the intake passage 3, nonsymmetric turbulance (Karman trail) is produced in the down stream of the prism 4*a* as illustrated in FIG. 2. It is known that the frequency produced by the turbulance is proportional to the velocity of the air flowing through the intake passage 3 under a predetermined condition, therefore, the velocity of the air (or the volume flow rate) is detected by measuring the frequency produced by the turbulance.

Accordingly, as shown in FIG. 2, an ultrasonic wave ($S_{IN}$) generated by the speaker 4*b*, under the condition that the turbulance of a frequency proportional to the velocity of the air flow is produced down stream of the prism 4*a*, is subjected to amplitude modulation and frequency modulation caused by the turbulance, and then received by the microphone 4*c*. This modulated signal ($S_{OUT}$) is eliminated of higher harmonics component by a wave shaping circuit 6 including a low pass filter and other elements and only a modulated frequency signal of an envelope component is selected, thus detecting an oscillating voltage signal $E\omega$ (FIGS. 2 and 3-*a*) having a frequency proportional to the air flow velocity, that is the air volume rate, and fluctuating periodically:

This oscillating voltage signal $E\omega$ is converted into a succession of driving pulses $P\omega$ (FIG. 3-*a*) synchronized to the frequency of the signal $E\omega$, or a divided down frequency thereof.

Then, the driving pulse $P\omega$ is continuously applied to a solenoid coil 8*a* of an electromagnetically actuated fuel injection valve 8 causing the fuel injection valve 8 to synchronize or follow the frequency of said driving pulse $P\omega$, that is the frequency or its divided-down frequency of the oscillating voltage signal $E\omega$.

Each pulse width $\tau$ of the driving pulse $P\omega$ is optionally determined depending on the performance of the fuel injection valve 8.

The fuel injection valve 8 is disposed at the down stream side of the air flow rate detecting device 4 for the throttle valve 2, more particularly, at a junction 9*a* of an intake passage 9 down stream and having a fuel outlet, and in the magnetic field space of a valve housing 8*b* which is subjected to the magnetic field of the solenoid coil 8*a* in the fuel injection valve 8. A plunger 8*c* on which a needle valve 8*d* is formed is inserted through the solenoid coil 8*a* and the other end of the plunger 8*c* is supported by the valve housing 8*b* through a spring 8*e* urging the needle valve 8*d* to close.

The needle valve 8*d* opens as the plunger 8*c* is pulled up a predetermined stroke against the spring 8*e* when succession of the driving pulses Pω produced by a microcomputer 7 is applied to the solenoid 8*a* of the fuel injection valve 8 and while the driving pulse is not applied to the solenoid 8*a*, the spring 8*e* depresses the plunger 8*c* to close the needle valve 8*d*.

A fuel pressure regulator 10 has the first chamber 10*b* and a second chamber 10*c* partitioned by a diaphragm 10*a*. The first chamber 10*b* is connected to the fuel injection valve 8 with a fuel feed pipe 11 while the second chamber 10*c* is connected to an opening on the intake passage 9 in the vicinity of the fuel outlet with a vacuum tube 12.

A fuel return tube 15 is provided between said first chamber 10*b* and a fuel tank 13. An electric fuel pump P is provided on the fuel feed pipe 11 to supply the fuel regulated at a constant pressure from the fuel tank 13.

A valve 10*d*, for regulating the fuel return rate by regulating the opening of the return tube 15 in the first chamber 10*b*, is fixed to the diaphragm 10*a* in the first chamber 10*b*. A spring 10*e*, provided in the second chamber 10*c* pushes the valve 10*d* through the diaphragm 10*a* in the direction closing the valve 10*d*.

When the pressure in the intake passage 9 decreases, the pressure in the second chamber 10*c* decreases so that the diaphragm 10*a* is pushed against the spring 10*e* opening the valve 10*d* to allow a part of the fuel to return into the fuel tank 13 through the fuel return tube 15, then the fuel pressure feeding the fuel to the fuel injection valve 8 is reduced, thus maintaining the pressure differential between the fuel feed pressure to the fuel injection valve 8 and the suction pressure (intake passage vacuum pressure) in the vicinity of the fuel outlet of the fuel injection valve 8.

An operating condition detecting means is provided to detect the temperature of the cooling water for an engine 17, the load condition, the acceleration and deceleration rate and the engine operating condition and to produce electric signals responsive to those conditions.

The operating condition detecting means includes in the engine 17 a sensor 16*a* for detecting the temperature of the engine cooling water, a sensor 16*b* for detecting the acceleration and deceleration level of the engine 17, a sensor 16*d* for detecting the oxygen density in the exhaust gas and a control circuit 16 which generates electric signals through a previously programmed arithmetic means after integrally judging the input signals received from those sensors 16*a* through 16*d*.

The control circuit 16 is included in the micro-computer 7. The input signals from the sensors 16*a*, 16*b*, 16*c* and 16*d* are fed to the control circuit 16 from terminals A, B, C and D are then transferred to the main control circuit of the micro-computer 7.

The main control circuit modulates the predetermined pulse width $\tau$ of the driving pulse Pω applied to the fuel injection valve 8 in response to the electric signals generated from the control circuit 16 of the operating condition detecting device.

A driving pulse Pω' having a pulse width thus modulated is output from the terminal E of the micro-computer 7 and applied to the fuel injection valve 8. , While the engine is driven under a specific operating conditions such as low speed and high loading, the air flowing through the intake passage 3 would like to flow back, to stand in the passage 3 as well as to generate air pulsation causing the air flow detecting device fail to detect the proper flow rate, detecting the rate twice as the actual rate and sometimes detecting no flow rate at all.

To prevent the above-mentioned improper detection, the fuel feed device according to the present invention is provided with second electric control means capable of controlling the fuel injection valve by means of the electric signals from the specific operating condition detecting means of the engine 17 prior to the electrical signals $S_{OUT}$ transmitted from the air flow rate detecting device under the above-mentioned operating condition of the engine 17.

In the embodiment of the present invention, the micro-computer 7 functioning as the first electric control means does also functions as the second electric control means.

Detailed description will be made of the specific operating condition detecting means of the engine 17 (Detecting means of specific operating conditions) and the micro-computer 7 as the second electric control means to control the fuel injection valve 8 prior to the electrical signals $S_{OUT}$ from the air flow rate detecting device 4 which are generated by the electrical signals from said specific operating condition detecting means.

The specific operating condition detecting means of the engine is comprised of a rotation sensor 18 to detect the rotation speed of the engine 17 and a load sensor 19 to detect the load of the engine 17.

For the rotation sensor 18, the contact breaker of the distributor is used to input electrical signals $S_{REV}$ from the primary terminal of an ignition coil 20 into the micro-computer 7 as the second electric control means. Thereby, the electric signal $S_{REV}$ depending on the rotation speed of the engine 17 is being input into the micro-computer 7 as the second electric control means from the primary terminal of said ignition coil.

For the load sensor 19, the suction pressure detecting sensor in the intake passage of the engine 17 which is composed of the combination of a diaphragm unit 21 having a chamber communicating with the vacuum pipe 12, a variable resistor 22 having a sliding terminal 22*a* communicated to a diaphragm 21*b* of said diaphragm unit and power source 23 is used, and the sliding terminal 22*a* of the variable terminal 22 is connected to the F terminal of the micro-computer functioning as the second electrical control means. Thereby a electric signal $S_{VAC}$ depending on the suction pressure in the intake passage of the engine 17 is input into the terminal F in the micro-computer 7 which is functioning as the second electric control means.

In the chamber 21*a* of the diaphragm unit 21 a spring 21*c* is loaded.

As stated above, since the rotation speed data $S_{REV}$ and the suction pressure data $S_{VAC}$ in the intake passage are input into the micro-computer 7 which functions as the second electric control means, said micro-computer 7 can judge whether the engine is operated under the specific driving condition or not.

Namely, said micro-computer 7 can judge whether the rotation speed is above or below the designated value according to the data $S_{REV}$ and $S_{VAC}$ transmitted from the sensors 18 and 19 and also can judge whether the suction pressure in the intake passage is above or below the designated value, and if the values of both the rotation speed and the suction pressure in the intake passage are under the designated values, the operating condition at such time is judged as the specific driving condition, while if not, as the other driving condition (hereinafter referred to us "normal driving condition").

When the operating condition of the engine at that time is judged as the normal driving condition, the fuel injection valve 8 is controlled to open and close by the pulse Pω (FIG. 3-*b*) having a frequency which is modulated by the first electric control means being based on the electrical signals $S_{OUT}$ from the air flow rate detecting device 4. On the other hand, when the operating condition is judged as the specific driving condition, said fuel injection valve 8 is controlled to open and close by a pulse Pωp (FIG. 3-*d*) having a frequency which is modulated by the second electric control means based on the electrical signals $S_{REV}$ consisting of the rotation speed data of the engine 17 transmitted from the specific driving condition detecting means. The electrical signal $S_{REV}$ composing of the rotation speed data of the engine 17 is also converted into the driving pulse Pωp (FIG. 3-*d*) in synchronism with the frequency responsive to the rotation speed of the engine 17 or its divided-down frequency by means of the micro-computer 7, then, is continuously applied to the fuel injection valve 8 through the terminal E of the micro-computer the same as in the normal driving condition of the engine.

Each pulse width τ of the driving pulse raw Pωp is optionally determined by the performance of the fuel injection valve 8.

The micro-computer 7 functioning as the second electric control means is provided with pulse width modulation means to modulate the electrical signals from the specific driving condition detecting device, that is the pulse width τ supplied into the fuel injection valve 8 in response to the electrical signal $S_{VAC}$ transmitted from the load sensor 19.

That is to say, the electrical signal $S_{VAC}$ from the load sensor 19 is input either through the above-mentioned control circuit 16 or directly into the main control circuit of the micro-computer 7 in which the pulse width τ of the driving pulse Pωp in response to those electrical signal $S_{VAC}$ can be modulated, and such driving pulse raw Pωp' (FIG. 3-*e*) with modulated pulse width is output from the terminal "F" of the micro-computer 7 and is applied to the fuel injection valve 8. Reference numeral 24 in FIG. 1 designated an exhaust pipe.

As the fuel feed device according to the present invention is constricted as described hereinabove, the engine operating condition can first be judged whether it is operated under the specific driving condition or under the normal driving condition by means of the micro-computer 7.

For example, when the operating condition is judged to be the normal driving condition, the fuel injection valve 8 is controlled to open and close by means of the first electric control means.

That is to say, the flow rate or flow volume of the air suctioned through the air cleaner 1 is converted into the oscillating voltage signal Eω having the frequency proportional to the air flow rate and etc. by means of the air flow rate detecting device 4.

After the oscillating voltage signal Eω has been converted into the driving pulse Pω synchronized with or following its frequency or the divided-down frequency, it is applied to the fuel injection valve 8 thereby controlling the opening and closing of the fuel injection valve 8 synchronized with or following the driving pulse Pω.

During the above process, the pressure of the fuel, that is the fuel pressure in the first chamber 10*b* of the fuel pressure regulator 10, is controlled in the following way.

Namely, when the fuel pressure in the first chamber 10*b* is increased and exceeds the component of forces of the suction force due to the intake passage vacuum pressure in the intake passage 9 acting against the diaphragm 10*a* and spring force of the spring 10*e*, the valve 10*d* is opened, while said fuel pressure is decreased and falls below said component of forces, the valve 10*d* is then closed, and thus the fuel pressure in the first chamber 10*b* is kept in the close agreement with the above-mentioned components of forces. Then this fuel with adjusted pressure is supplied into the fuel injection valve 8 so that the fuel having the fixed pressure difference from the inner pressure of the intake passage in response to the opening and closing of the fuel injection valve 8 is injected into the intake passage 9.

Figure 3:
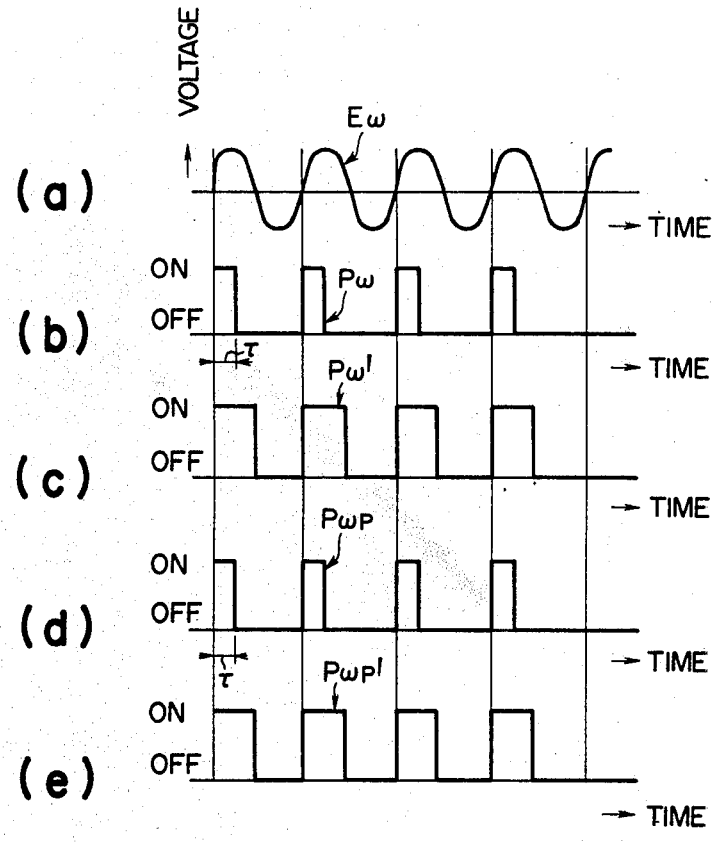
FIG. 3*a* through FIG. 3*e* are wave forms to explain the function of the air flow detecting device.

Under such condition, if either one of the said engine operating conditions is changed and the signal from any of sensors 16*a* through 16*d* is input into the control circuit 16, the said control circuit 16 sends the output signal responsive to the input signal into the main control circuit of the micro-computer 7. Therefore, the main control circuit modulates the pulse width τ of the driving pulse Pω applied into the fuel injection valve 8 in accordance with the electric signal from the control circuit 16, then supplies the driving pulse Pω' modulated as shown in FIG. 3-*c* from the terminal E into the fuel injection valve 8 to control opening and closing of the valve.

As the fuel injection valve 8 is opened in response to the pulse width of the modulated driving pulse Pω', the fuel injection rate is varied in accordance with the above-mentioned engine operating condition and the fuel injection is optionally electronically controlled responsive to the engine operating condition.

When the intake passage vacuum pressure is increased, the diaphragm 10*a* is pulled towards the second chamber 10*c*, therefore, the opening of the valve 10*d* is increased thereby increasing the fuel amount which is fed back into the fuel tank 3 through the return tube 15 which in turn reduces the pressure of fuel supplied into the fuel injection valve 8 to maintain the pressure difference between the intake passage vacuum pressure and the pressure of the fuel supplied into the fuel injection valve 8 nearly constant.

By the way, when the operating condition of the engine 17 is changed into the low speed and high load driving condition (specific driving condition), the condition is detected by the micro-computer 7, and the fuel injection valve 8 is controlled by the second control means instead of the first electric control means.

In this state, the fuel injection valve 8 is controlled by the electrical signal from the specific driving condition detecting means prior to the electrical signal $S_{OUT}$ from the air flow rate detecting device 4. That is to say, after the electrical signal $S_{REV}$ from the rotation speed sensor 18 has been converted into the driving pulse Pωp synchronized with the frequency and the divided-down frequency of the electrical signal $S_{REV}$ by means of the micro-computer 7, it is applied to the fuel injection valve 8 to have said fuel injection valve 8 controlled synchronized with the driving pulse raw Pωp.

The micro-computer 7 modulates the pulse width τ of the driving pulse Pωp which is applied to the fuel injection valve 8 in accordance with the electrical signal $S_{VAC}$ from the load sensor 19, and then supplies the modulated driving pulse Pωp' as shown in FIG. 3-*e* into the fuel injection valve 8 from the terminal E to control opening and closing of the valve.

Thus, the optimum fuel injection can be controlled under the specific driving condition of the engine. Even in the specific engine driving condition, the data from the sensors 16*a* through 16*d* are input into the main control circuit of the micro-computer 7 the same as in the case of the normal engine driving condition, and they serves to contribute to the modulation control of the opening and closing duration $\tau$ of the fuel injection valve 8. And also in the specific engine driving condition, the fuel pressure regulator 10 functions to keep the pressure difference between the pressure of fuel supplied into the fuel injection valve 8 and the suction pressure in the vicinity of the fuel outlet of the said fuel injection valve 8 constant.

As described in the preferred embodiment of the invention, under the specific engine driving condition, the electrical signal $S_{REV}$ having the rotation speed data of the engine 17 may be used as an electrical signal contributing to the pulse width modulation of the driving pulse $P\omega p$ instead of the electrical signal $S_{VAC}$ having the suction pressure in the intake passage, and moreover, both the electrical signals $S_{REV}$ and $S_{VAC}$ can be used. In this case, although the electrical signals from the sensors 16*a* through 16*d* contribute to the modulation control of the pulse width of the fuel injection valve 8, it is not necessary to contribute only electrical signal $S_{VAC}$ or $S_{REV}$ or $S_{REV}$, $S_{VAC}$ may be used to control the pulse width of the fuel injection valve 8.

As the suction pressure detecting sensor in the intake passage of the engine 17, paying attention that the opening of the throttle valve 2 is proportional to the suction pressure in the intake passage, the load sensor for generating an electrical signal in response to the opening of the throttle valve may be used instead of the load sensor 19 as shown in the preferred embodiment of the present invention.

In this case, the load sensor may comprise a variable resistor having a sliding terminal connected to the axle of the throttle valve and a power supply connected to the variable resistor so that the electric signal representative of throttle setting from the load sensor is input into the micro-computer 7.

Furthermore, as stated hereinabove, instead of using the first and the second electric control means for the micro-computer 7, the micro-computer having each electric control means composed separately may be used.

Resistance variation of a thermister sensor may be used for detecting the frequency of the Karmen trail instead of the speaker 4*b* and the microphone 4*c* constituting the air flow detecting device 4.

In this structure, a pair of thermister sensors are buried symmetrically in the front face of the prism 4*a* and connected to form two sides of a bridge circuit and a very small current is introduced to the circuit from a constant current power source. Alternate eddies produced by the flow of air cause the resistance of the pair of the thermister sensors to change alternately in a frequency equal to that of the alternate eddy production, consequently, an electric signal of a frequency proportional to the air flow rate is obtained as a bridge circuit generates one cycle of oscillating voltage signal at the generation of a pair of eddies.

The wave shaping circuit 6 and the control circuit 16 constituting the driving condition detecting device may be provided integrally in or separately from the micro-computer 7.

The fuel injection valve 8 may be disposed upstream of the throttle valve 2 instead of being disposed downstream of the said valve in the intake passage.

It will be understood from what has been described hereinbefore that the fuel feed device for an engine of the present invention has the advantage that highly reliable electronically controlled fuel feed is effected as the first electric control means can control opening and closing of the fuel injection valve 8 in accordance with the electrical signal output from the air flow rate detecting device 4 when the engine 17 is under the normal driving condition while the second electric control means can control said fuel injection valve 8 in accordance with the electric signals output from the specific engine having condition detecting means prior to the electric signals from said air flow rate detecting device 4 when the engine is operated under the specific driving condition.

What is claimed is:

1. A fuel feed device comprising: an air flow rate detecting device to generate an electric signal having a frequency proportional to an air flow rate suctioned through an intake passage, an electromagnetically actuated fuel injection valve which is disposed downstream of said air flow rate detecting device to control the fuel feed rate into said intake passage, a fuel pressure regulator to maintain the pressure difference between a fuel feed pressure to said fuel injection valve and a suction pressure near a fuel outlet of said fuel injection valve constant, first electric control means for controlling opening and closing of said fuel injection valve so that it will synchronize with at least either a frequency of the electric signal generated by said air flow rate detecting device or a divided-down frequency thereof, operating condition detecting means for detecting engine operating conditions, said operating condition detecting means comprising a rotation speed sensor for sensing engine rotation speed and a load sensor for sensing engine load and for generating electrical signals respectively representative of engine rotation speed and load, second electric control means effective to apply the electrical signals generated by said operating condition detecting means to control opening and closing of said fuel injection valve in synchronism with the electrical signals from said operating condition detecting means at a frequency or a divided-down frequency of the operating condition detecting means output signals, said second control means being effective to open and close said fuel injection valve when a low speed high load engine operating condition is detected and said fuel injection valve is controlled to open and close by said first electric control means during other operating conditions.

2. A fuel feed device according to claim 1, wherein said rotation speed sensor is comprised of a contact breaker for a distributor.

3. A fuel feed device according to claim 1, wherein said load sensor is comprised of a suction pressure detecting sensor in said intake passage of said engine.

4. A fuel feed device according to claim 1, wherein said load sensor is comprised of means for detecting the degree of opening of a throttle valve.

5. A fuel feed device according to claim 1, wherein said second electric control means is comprised of means for controlling the opening duration of said fuel injection valve in response to the electric output signals from said operating condition detecting means.

6. A fuel feed device according to claim 5, wherein said second electric control means is comprised of means for detecting the operating condition in accordance with the electric signals output from the operating condition detecting means and means for generating an electric signal to control the opening of said fuel injection valve in said first electric control means.

7. A fuel feed device comprising: an air flow rate detecting device to generate an electric signal having a frequency proportional to an air flow rate suctioned through an intake passage, an electromagnetically actuated fuel injection valve which is disposed downstream of said air flow rate detecting device to control the fuel feed rate into said intake passage, a fuel pressure regulator to maintain the pressure difference between a fuel feed pressure to said fuel injection valve and a suction pressure near a fuel outlet of said fuel injection valve constant, first electric control means for controlling opening and closing of said fuel injection valve so that it will follow at least either a frequency of the electric signal generated by said air flow detecting device or a divided-down frequency thereof, operating condition detecting means for detecting an engine operating condition, said operating condition detecting means comprising a rotation speed sensor for sensing engine rotation speed and a load sensor for sensing engine load and for generating electrical output signals respectively representative of engine rotation speed and load, second electric control means for opening and closing said fuel injection valve in synchronism with the frequency or a divided-down frequency of the electric output signals from said operating condition detecting means that are representative of engine rotation speed, said second electric control means being effective to open and close said fuel injection valve when a low speed high load engine operating condition is detected and said fuel injection valve being controlled by said first electric control means under other operating conditions.

* * * * *